US006475975B1

(12) United States Patent
Kinscherf et al.

(10) Patent No.: US 6,475,975 B1
(45) Date of Patent: Nov. 5, 2002

(54) BLUE COLORED LIQUID CRYSTAL COMPOSITIONS

(75) Inventors: Kevin Kinscherf, Freehold, NJ (US); Harry Aszman, Englishtown, NJ (US); Barbara Thomas, Princeton, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/124,033

(22) Filed: Apr. 17, 2002

(51) Int. Cl.[7] ..... C11D 17/00

(52) U.S. Cl. ..... 510/417; 510/423; 510/424; 510/425; 510/428; 510/507; 510/509

(58) Field of Search ..... 510/417, 423, 510/425, 424, 428, 507, 509

(56) References Cited

U.S. PATENT DOCUMENTS 5,549,840 A * 8/1996 Mondin et al. ..... 510/365
5,861,367 A * 1/1999 Banvalet et al. ..... 510/365
5,874,393 A * 2/1999 Drapier et al. ..... 50/417
6,008,180 A * 12/1999 Drapier et al. ..... 510/417
6,030,935 A * 2/2000 Drapier et al. ..... 510/417
6,046,151 A * 4/2000 Drapier et al. ..... 510/417
6,048,834 A * 4/2000 Drapier et al. ..... 510/417
6,121,228 A * 9/2000 Drapier et al. ..... 510/417
6,281,187 B1 * 8/2001 Smerznak ..... 510/418

* cited by examiner

*Primary Examiner*—Necholus Ogden
(74) *Attorney, Agent, or Firm*—Richard E. Nanfeldt

(57) ABSTRACT

This invention relates to a blue colored liquid crystal composition comprising an ethoxylated nonionic surfactant, an ethoxylated alkyl ether sulfate surfactant, a sulfonate surfactant, a magnesium inorganic salt, an abrasive, a blue colorant and water.

3 Claims, No Drawings

BLUE COLORED LIQUID CRYSTAL COMPOSITIONS

FIELD OF THE INVENTION

This invention relates to a blue colored liquid crystal detergent composition. More specifically, it is of a blue colored liquid detergent composition in a liquid crystal state which when brought into contact with tough difficult to clean soils is superior to other liquid detergent compositions in detergency and in other physical properties as well as provides a sharp contrast to the surface being cleaned thereby making it easier to see the endpoint when rinsing the product from the surface being cleaned.

BACKGROUND OF THE INVENTION

Liquid aqueous synthetic organic detergent compositions have long been employed for human hair shampoos and as dishwashing detergents for hand washing of dishes (as distinguished from automatic dishwashing machine washing of dishes). Liquid detergent compositions have also been employed as hard surface cleaners, as in pine oil liquids, for cleaning floors and walls. More recently they have proven successful as laundry detergents too, apparently because they are convenient to use, are instantly soluble in wash water, and may be employed in "pre-spotting" applications to facilitate removal of soils and stains from laundry upon subsequent washing. Liquid detergent compositions have comprised anionic, cationic and nonionic surface active agents, builders and adjuvants, including, as adjuvants, lipophilic materials which can act as solvents for lipophilic soils and stains. The various liquid aqueous synthetic organic detergent compositions mentioned serve to emulsify lipophilic materials, including oily soils, in aqueous media, such as wash water, by forming micellar dispersions and emulsions. They also serve to disperse and suspend particulate soils.

Although emulsification is a mechanism of soil removal, it has been only comparatively recently that it was discovered how to make microemulsions which are much more effective than ordinary emulsions in removing lipophilic materials from substrates. Such microemulsions are described in British Patent Specification No. 2,190,681 and in U.S. Pat. Nos. 5,075,026; 5,076,954 and 5,082,584 and 5,108,643, most of which relate to acidic microemulsions useful for cleaning hard surfaced items, such as bathtubs and sinks which microemulsions are especially effective in removing soap scum and lime scale from them. However, as in Ser. No. 4,919,839 the microemulsions may be essentially neutral and such are also taught to be effective for microemulsifying lipophilic soils from substrates. In U.S. patent application Ser. No. 7/313,664 there is described a light duty microemulsion liquid detergent composition which is useful for washing dishes and removing greasy deposits from them in both neat and diluted forms. Such compositions include complexes of anionic and cationic detergents as surface active components of the microemulsions.

The various microemulsions referred to include a lipophile, which may be a hydrocarbon, a surfactant, which may be an anionic and/or a nonionic detergent(s), a co-surfactant, which may be a poly-lower alkylene glycol lower alkyl ether, e.g., tripropylene glycol monomethyl ether, and water.

Although the manufacture and use of detergent compositions in microemulsion form significantly improve cleaning power and greasy soil removal, compared to the usual emulsions, the present invention improves them still further and also increases the capacity of the detergent compositions to adhere to surfaces to which they have been applied. Thus, they drop or run substantially less than cleaning compositions of "similar" cleaning power which are in microemulsion or normal liquid detergent form. Also, because they form microemulsions with lipophilic soil or stain material spontaneously, with essentially no requirement for addition of any energy, either thermal or mechanical, they are more effective cleaners at room temperature and at higher and lower temperatures that are normally employed in cleaning operations than are ordinary liquid detergents, and are also more effective than detergent compositions in microemulsion form.

U.S. Pat. No. 5,035,826 teaches liquid crystal compositions but these compositions exhibit thermal stability in the limited temperature range of 19° C. to 36° C.

SUMMARY OF THE INVENTION

The present invention provides an improved, blue colored liquid crystal detergent composition having lower interfacial tension which improves cleaning hard surface in the form of a liquid crystal which is suitable for cleaning hard surfaces such as plastic, vitreous and metal surfaces having a shiny finish, oil stained floors, automotive engines and other engines. More particularly, the improved cleaning compositions exhibit good grease soil removal properties due to the lower interfacial tension and suspended abrasives. These new compositions leave the cleaned surfaces shiny without the need of or requiring only minimal scrubbing without additional rinsing or wiping. The latter characteristic is evidenced by little or no visible residues on the unrinsed cleaned surfaces and, accordingly, overcomes one of the disadvantages of prior art products.

The blue color of the liquid crystal detergent composition has a sharp contrast with the target surface being cleaned. Therefore, it is easier to see the end point when rinsing the liquid crystal detergent composition from the surface being cleaned.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, liquid crystal, cleaning composition especially effective in the removal of oily and stuck-on food from dishware. The blue colored liquid crystal composition includes, on a weight basis:

(a) 0.5% to 6% of an ethoxylated alkyl ether surfactant;

(b) 10% to 24% of a sodium salt of a $C_8$–$C_{16}$ linear alkyl benzene sulfonate surfactant;

(c) 1% to 10% of at least one ethoxylated nonionic surfactant;

(d) 0.5% to 6%, more preferably 0.5% to 5% of a magnesium, sodium, calcium or potassium salt such as magnesium sulfate heptahydrate and/or magnesium chloride.

(e) 10% to 22% of an abrasive such as a calcium carbonate; and (f) 0.005% to 0.1%, more preferably 0.01% to 0.06% of a blue colorant; and (g) the balance being water, wherein the composition does not contain a zwitterionic surfactant or a cosurfactant such as glycerol, ethylene glycol, water-soluble polyethylene glycols having a molecular weight of 300 to 1000, polypropylene glycol of the formula $HO(CH_3CHCH_2O)_nH$ wherein n is a number from 2 to 18, mixtures of polyethylene glycol and polypropyl glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1methoxy 2-, 3- or 4-butanol and the liquid crystal composition has a storage modulus equal to or higher than one Pascal (1 Newton/sq. m.), more preferably higher than 30 Pascal at a temperature of 20° C. to 40° C. at a strain of 0.1% to 5% and a frequency of 10 radians/second as measured on a Carri-Med $CSL^2$ 500 Rheometer and is thermally stable and exists as a liquid crystal in the temperature range from 8° C. to 43° C., more preferably 4° C. to 43° C.

DETAILED DESCRIPTION OF THE INVENTION

The present invention relates to a stable blue colored liquid crystal detergent composition comprising approximately by weight: 0.5% to 6% of an ethoxylated $C_8$–$C_{18}$ alkyl ether sulfate, 1% to 10% of an ethoxylated nonionic surfactant, 10% to 24% of a sodium salt of a $C_8$–$C_{16}$ linear alkyl benzene sulfonate surfactant, 0.5% to 6%, more preferably 0.5% to 5% of a magnesium, sodium, calcium or potassium salt, 10% to 22% of an abrasive such as a calcium carbonate, 0.005% to 0.1%, more preferably 0.01% to 0.06% of a blue colorant and the balance being water, wherein the composition does not contain a zwitterionic surfactant or a cosurfactant such as glycerol, ethylene glycol, water-soluble polyethylene glycols having a molecular weight of 300 to 1000, polypropylene glycol of the formula $HO(CH_3CHCH_2O)_nH$ wherein n is a number from 2 to 18, mixtures of polyethylene glycol and polypropyl glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1methoxy-2-propanol, 1methoxy-3-propanol, and 1methoxy 2-, 3- or 4-butanol and the liquid detergent composition has a storage modulus equal to or higher than one Pascal (1 Newton/sq. m.), more preferably higher than 10 Pascal at a temperature of 20° C. to 40° C. at a strain of 0.1% to 5% second as measured on a Carri-Med $CSL^2$ 500 Rheometer and is thermally stable and exists as a liquid crystal in the temperature range from 8° C. to 43° C., more preferably 4° C. to 43° C.

The blue colored liquid crystal detergent composition has an L* value of about 41.67 to about 42.67, an a* value of about −5.13 to about −5.53, a b* values of about −8.98 to about −9.58, a C* value of about 10.20 to about 11.20 and a h* value of about 238.13 to about 242.13 under a light source of Daylight D65/10.

The nonionic surfactant is present in amounts of about 1% to 10%, preferably 2% to 8% by weight of the liquid crystal composition and provides superior performance in the removal of oily soil and mildness to human skin.

The ethoxylated nonionic surfactants utilized in this invention are commercially well known and include the primary aliphatic alcohol ethoxylates and secondary aliphatic alcohol ethoxylates. The nonionic synthetic organic surfactants generally are the condensation products of an organic aliphatic or alkyl aromatic hydrophobic compound and hydrophilic ethylene oxide groups. The length of the polyethenoxy chain can be adjusted to achieve the desired balance between the hydrophobic and hydrophilic elements.

The nonionic surfactant class includes the condensation products of a higher alcohol (e.g., an alkanol containing about 8 to 16 carbon atoms in a straight or branched chain configuration) condensed with about 2.5 to 20 moles of ethylene oxide, for example, lauryl or myristyl alcohol condensed with about 16 moles of ethylene oxide (EO), tridecanol condensed with about 6 moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 2.5 to 10 moles of ethylene oxide (Neodol 91-8 or Neodol 91-5), $C_{12-13}$ alkanol condensed with 3 moles ethylene oxide (Neodol 23-3), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 7 to 9 and give good O/W emulsification, whereas ethoxamers with HLB values below 7 contain less than 4 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Dow and Union Carbide.

The ethoxylated alkyl ether sulfate, surfactants which may be used in the composition of this invention are water soluble such as triethanolamine and include the sodium, potassium, ammonium and ethanolammonium salts of an $C_{8-18}$ ethoxylated alkyl ether sulfate surfactants have the structure:

$$R—(OCHCH_2)_nOSO^-{}_3M^+$$

wherein n is about 0 to about 5 and R is an alkyl group having about 8 to about 18 carbon atoms, more preferably 12 to 15 and natural cuts, for example, $C_{12-14}$; $C_{12-15}$and M is an ammonium cation or a metal cation, most preferably sodium. The ethoxylated alkyl ether sulfate is present in the composition at a concentration of about 0.5% to about 6% by weight, more preferably about 1% to 5% by weight.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt. %.

The sulfonated anionic surfactant used in the instant composition is the well known higher alkyl mononuclear aromatic sulfonates, such as the higher alkylbenzene sulfonates containing 8 to 18 or preferably 8 to 16 carbon atoms in the higher alkyl group in a straight or branched chain, or $C_8$–$C_{15}$ alkyl toluene sulfonates. A preferred alkylbenzene sulfonate is a sodium salt of linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The abrasive which is used at a concentration of 10 wt. % to 22 wt. %, more preferably 12 wt. % to 20 wt. % is selected from the group consisting of polyethylene powders, calcium carbonate and silica and mixtures thereof. A preferred calcium carbonate is Calcite Q100 manufactured by Huber Engineered Materials. A preferred silica is White Silex—120 grade by U.S. Silica. Another preferred silica is Tixosil 103 manufactured by Rhodia.

The blue colorant used in the instant composition is selected from the group consisting of Acid Blue 1 (Cas No. 129-17-9), Acid Blue 3 (Cas No. 3536-49-0), Acid Blue 5 (Cas No. 3374-30-9), Acid Blue 7, (Cas No. 3486-30-4), Acid Blue 9 (Cas Nos. 2650-18-2,; 37307-56-5 and 6371-85-3) Solvent Blue 63 (Cas No. 64553-79-3), Acid Blue 80 (Cas. No. 4474-24-2), Acid Blue 62 (Cas. No. 4368-56-3), Vat Blue 4 (Cas. No. 81-77-6), Vat blue 6/Pigment 64 (Cas. No. 130-20-1), Vat Blue 1/Pigment Blue 66 (Cas. No. 482-89-3), Acid Blue 74/food blue 1, Pigment Blue 63 (Cas. No. 860-22-0), Pigment Blue 16 (Cas. No. 574-93-6), Pigment Blue 15 (Cas. No. 147-14-8), Direct Blue 86 (Cas. No. 1330-38-7), Pigment Blue 29 (Cas. Nos. 1317-97-1 and 57455-37-5), pigment Blue 27 (Cas. No. 14038-43-8), Guaizulene (Cas. No. 489-84-9), Bimothymol Blue (Cas. No. 76-59-5) and especially, liquitint blues manufactured by Milliken Chemical which is reactive blue dye such as Cl reactive Blue 5, Cl reactive Blue 2, Cl reactive Blue 4, Cl reactive Blue 7, Cl reactive Blue 15, Cl reactive Blue 19 or Cl reactive Blue 27 react through an electrophilic reactive group bonded to the reactive dye with a nucleophilic linking group which is attached to a poly (oxyalkylene)-containing moiety.

The instant composition contains 0.5 to about 6 wt. %, more preferably about 0.5 to about 5 wt. % of a magnesium, sodium, calcium or potassium salt such as magnesium sulfate and mixtures thereof.

The final essential ingredient in the inventive liquid crystal compositions having improved interfacial tension properties is water. The proportion of water in the liquid crystal detergent composition generally is in the range of 20% to 97%, preferably 70% to 97% by weight.

The instant composition can also contain 0 to 1.0%, more preferably 0.01% to 0.25% by weight of a pigment or dye and 0 to 1%, more preferably 0.01% to 0.5% of a fragrance.

A composition of this invention is in a liquid crystal state when it is of lypotropic structure, is opaque blue, and has a storage modulus equal to or higher than one Pascal (1 Newton/sq. m.), more preferably higher than 10 Pascal and most preferably higher than 20 Pascal and when measured at a temperature of 20 to 40° C., at a frequency of ten radians per second and at a strain of 0.1 to 5% and a frequency of 10 radians/second. The rheological behavior of the compositions of this invention were measured at 25° C. by means of a Carri-Med CSL$^2$ 500 Rheometer. In making the measurement, a cone and plate are used at a cone angle of 4 degrees with a cone diameter of 4 cm, measurement system gap of 119.0 micro meters and a measurement system inertia of 1.226 micro Nm $sec^{-2}$.

To make the liquid crystal compositions of the invention is relatively simple because they tend to form spontaneously with little need for the addition of energy to promote transformation to the liquid crystal state. However, to promote uniformity of the composition mixing will normally be undertaken and it has been found desirable first to mix the abrasive, color and anionic surfactants with the water, followed by the salt and then the nonionic surfactant is mixed with the fragrance. It is not necessary to employ heat and most mixings are preferably carried out at about room temperature (20–25° C.).

The invented compositions may be applied to such surfaces by pouring onto them, by application with a cloth or sponge, or by various other contacting means. Such application may be onto hard surfaces, such as dishes, pots, pans, counter tops, or range tops, from which lipophilic stuck on, greasy or oily soil is to be removed, or may be onto fabrics, such as laundry, which has previously been stained with lipophilic soils, such as motor oil. The invented compositions may be used as detergents and as such may be employed in the same manner in which liquid detergents are normally utilized in dishwashing, floor and wall cleaning and laundering, but it is preferred that they be employed as pre-spotting agents too, in which applications they are found to be extremely useful in loosening the adhesions of lipophilic stuck on soils to substrates.

The various advantages of the invention have already been set forth in some detail and will not be repeated here. However, it will be reiterated that the invention relates to the important discovery that effective liquid detergent compositions can be made in the liquid crystal state and that because they are in such state they are especially effective at suspending solid abrasive and thus removing lipophilic soils from substrates and also are effective in removing from substrates non-lipophilic materials. Such desirable properties of the liquid crystal detergent compositions of this invention make them ideal for use as pre-spotting agents and detergents for removing hard-to-remove soils from substrates in various hard and soft surface cleaning operations.

The following examples illustrate but do not limit the invention. Unless otherwise indicated, all parts in these examples, in the specification and in the appended claims are by weight and all temperature are in ° C.

EXAMPLE I

The following formula (wt. %) was made at 25° C. by simple mixing.

| | A |
|---|---|
| Calcite | 15.00 |
| Neodol 1–3 | 5.00 |
| Sodium alkyl ethoxylated ether | 1.1 |
| Sodium C8–C16 linear alkyl benzene sulfonate | 16.00 |
| Liquitint Blue HP Blue Colorant | 0.02 |
| Magnesium sulfate hetahydrate | 3.00 |
| Water | Bal. |
| Stable (yes/no) | Yes |
| Yield Stress, Pa | 70.00 |

The procedure to measure yield stress is described below.
Instrument: Carri-med $CSL^2$ 500 rheometer
Geometry: Cone and plate –4 degrees and 4 cm
Temperature: 25° C.
Procedure: Shear stress sweep from 10 to 150 Pascals.

The yield stress is calculated from a graph of shear stress vs. shear rate using the Bingham model.

The invention has been described with respect to various embodiments and illustrations of it but is not to be considered as limited to these because it is evident that one of skill in the art with the present specification before him or her will be able to utilize substitutes and equivalents without departing from the invention.

What is claimed is:

1. A blue colored liquid crystal detergent composition which comprises by weight:

(a) about 1% to about 10% of an ethoxylated nonionic surfactant containing ethylene oxide groups;

(b) about 0.5% to about 6% of a water soluble salt of an ethoxylated $C_{8-18}$ alkyl ether sulfate surfactant;

(c) 10% to 22% of a calcium carbonate abrasive;

(d) 10% to 24% of a sodium salt of a $C_8$–$C_{16}$ linear alkyl benzene sulfonate surfactant;

(e) 0.5% to 6% of a magnesium, sodium, calcium or potassium inorganic salt;

(f) 0.005% to 0.1% of a blue colorant; and (g) the balance being water, wherein said liquid crystal detergent composition has a storage modulus measured at a temperature between 20° C. to 40° C., at a strain of 0.1% to 5% and a frequency of 10 radians/second of at least about one Pascal and is one phase at a temperature of 8° C. to 43° C. and said composition does not contain an zwitterionic surfactant or a cosurfactant such as glycerol, ethylene glycol, water-soluble polyethylene glycols, polypropylene glycols, mono C1–C6 alkyl ethers and esters of ethylene glycol and propylene glycol.

2. The composition of claim 1, wherein said nonionic surfactant is a condensation product of one mole of a higher fatty alcohol having about 9 to about 11 carbon atoms with 2 to 6 moles of said ethylene oxide groups.

3. The composition of claim 2 wherein said water soluble salt of said ethoxylated $C_{8-18}$ alkyl ether sulfate surfactant has a cation selected from the group consisting of sodium, potassium and ammonium.

* * * * *